US005215069A

United States Patent [19]

Liu

[11] Patent Number: 5,215,069

[45] Date of Patent: Jun. 1, 1993

[54] CROSS BOW HAVING A SAFETY DEVICE

[76] Inventor: Cha-Chang Liu, P.O. Box 1750, Taichung, Taiwan

[21] Appl. No.: 827,764

[22] Filed: Jan. 29, 1992

[51] Int. Cl.[5] ..... F41B 5/12

[52] U.S. Cl. ..... 124/25; 124/35.1; 124/40

[58] Field of Search ..... 124/17, 20.1, 20.3, 124/25, 31, 35.1, 40

[56] References Cited

U.S. PATENT DOCUMENTS

| | | | |
|---|---|---|---|
| 2,267,065 | 12/1941 | Wilen | 124/40 X |
| 4,192,281 | 3/1980 | King | 124/25 |
| 4,258,689 | 3/1981 | Barnett | 124/25 |
| 4,693,228 | 9/1987 | Simonds et al. | 124/25 |
| 4,721,092 | 1/1988 | Waiser | 124/40 |
| 4,877,008 | 10/1989 | Troubridge | 124/25 |
| 5,085,200 | 2/1992 | Horton-Corcoran et al. | 124/25 |

*Primary Examiner*—Randolph A. Reese
*Assistant Examiner*—John Ricci

[57] ABSTRACT

A cross bow including a string engaged to a bow prod of a stock, a pair of bars for drawing the string to a cocked position, a butt pivotally coupled to the rear end of the stock, a recess formed in the rear end of the stock, a member disposed on the rear end of the stock and including two depressions, a trigger disposed in the stock and including a shoulder, and a lever pivotally supported in the stock having one end engageable with either of the depressions and the other end engageable with the shoulder of the trigger so as to lock the trigger.

3 Claims, 3 Drawing Sheets

CROSS BOW HAVING A SAFETY DEVICE

BACKGROUND OF THE INVENTION (1.) Field of the Invention

The present invention relates to a cross bow, and more particularly to a cross bow having a safety device.

(2.) Description of the Prior Art

A typical cross bow is disclosed in U.S. Pat. No. 4,258,689 to Barnett. In this cross bow, the string 13 is held in place only by a catch 17. However, as shown in FIG. 1 of this patent, the string 13 is exposed and will be easily separated from the engagement with the catch 17 so that the string 13 will be easily released. This is particularly dangerous when a bolt is disposed in place above the fore end portion 12 of the stock 10.

The present invention has arisen to mitigate and/or obviate the afore-described disadvantages of the conventional cross bows.

SUMMARY OF THE INVENTION

The primary objective of the present invention is to provide a cross bow which has a safety device provided to lock the trigger and to avoid inadvertent shot of the bolt.

In accordance with one aspect of the present invention, there is provided a cross bow comprising a stock including a front end and a rear end having a pin disposed therein, a bow prod supported on the front end of the stock, a string having opposite ends attached to corresponding ends of the bow prod, a cocking means for engaging the string and drawing the string from a rest position to a cocked position where the string is spaced rearwardly from the bow prod when the bow is cocked, a butt pivotally coupled to the rear end of the stock and including a catch disposed thereon for engagement with the pin of the stock so that the butt can be coupled to the stock, a recess formed in the rear end of the stock, a member disposed on the rear end of the stock and including a first depression and a second depression formed therein, a trigger disposed in the stock close to the rear end thereof and including a shoulder formed therein, and a lever having a middle portion pivotally coupled to the stock and including a first end engageable with either of the first depression and the second depression and a second end engageable with the shoulder of the trigger so as to lock the trigger when the first end of the lever is engaged with the second depression of the member, whereby, the first end of the lever is pushed to engage with the second depression and the second end of the lever is caused to engage with the shoulder of the trigger when the string is drawn to the cocked position such that the trigger is locked, and the trigger is unlocked when the first end of the lever is caused to move to engage with the first depression of the member.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
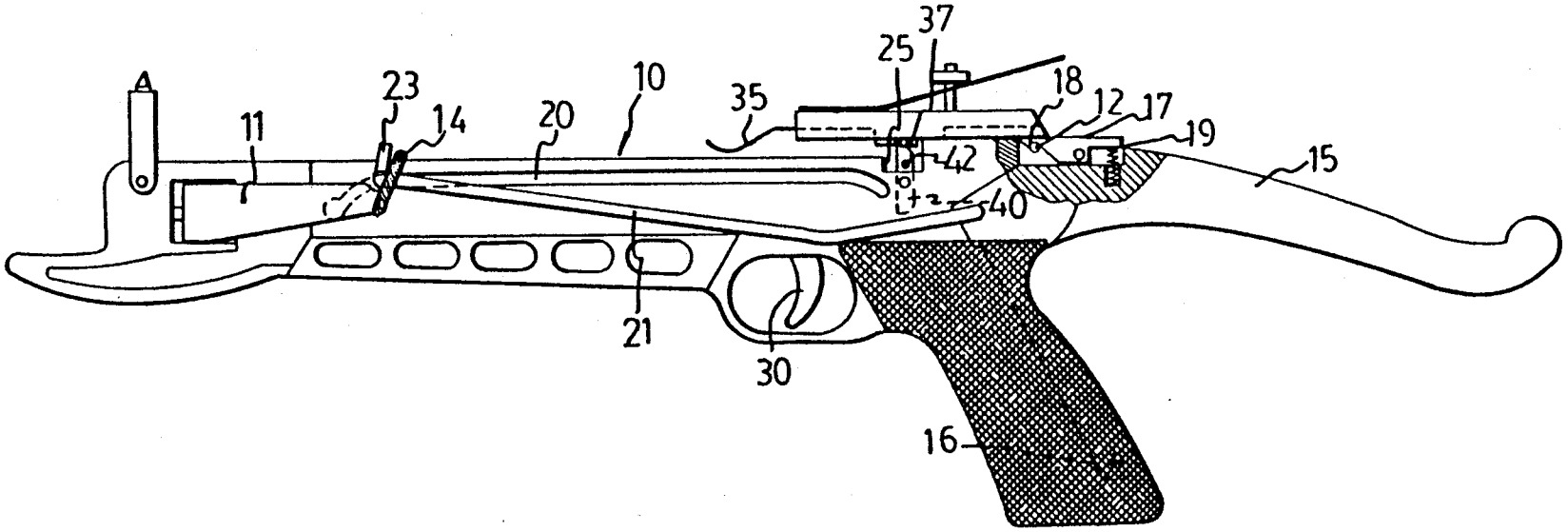
FIG. 1 is a plane view of a cross bow in accordance with the present invention.
Figure 2:
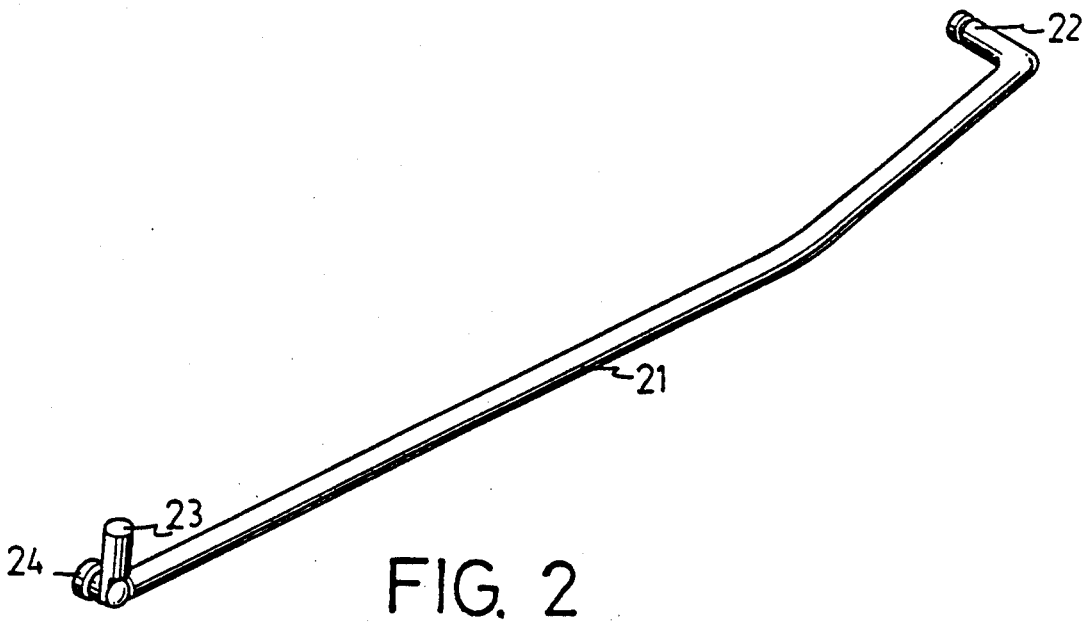
FIG. 2 is a perspective view of the bar.

Referring to the drawings and initially to FIGS. 1 and 2, a cross bow in accordance with the present invention comprises generally a stock 10, a resilient flexible bow prod 11 supported at the front end portion of the stock 10, and a string 14 including two opposite ends attached to corresponding ends of the bow prod 11. A pin 12 is disposed in the rear end portion of the stock 10. A butt 15 is pivotally connected to the stock 10 at a pivot axle 16. A catch 17 has a middle portion pivotally disposed in the butt 15 and includes a hook 18 formed in a first end and includes a second end biased by a spring 19 such that the hook 18 of the catch 17 can be biased toward the butt 15 in order to hook the pin 12 when the butt 15 is pushed toward the stock 10 and such that the butt 15 can be engaged to the stock 10.

The stock 10 includes two side surfaces each having a cam track 20 longitudinally formed therein. A pair of bars 21 are disposed in parallel on both sides of the stock 10 and each includes a first end 22 pivotally coupled to the butt 15 and a snag 23 fixed on a second end thereof. The snag 23 is substantially perpendicular to the length of the bar 21 so as to form a hook portion in order to engage with the string 14. A recess 25 is formed in the rear end portion of the stock 10. A slide 24 is fixed on the second end of each of the bars 21 and is slidably engaged in the respective cam track 20 of the stock 10 such that the second ends of the bars 21 can be guided to move along the cam tracks 20 and such that the string 14 can be drawn from a rest position to a cocked position where the string 14 is engaged in the recess 25.

Figure 3:
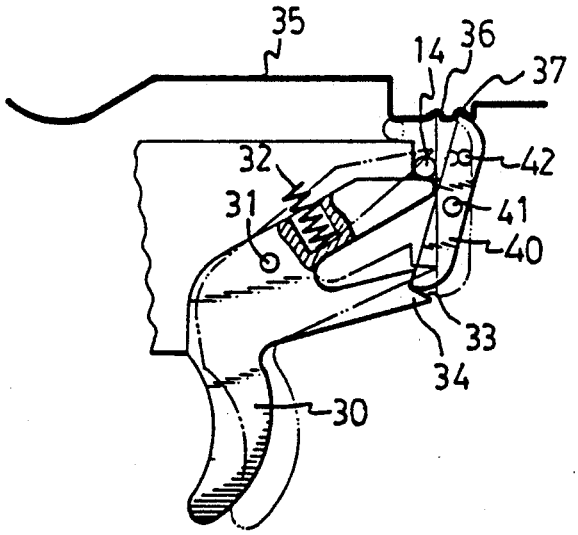
FIG. 3 is a schematic view illustrating the operations of the safety device.

Referring next to FIG. 3 and again to FIG. 1, a trigger 30 is pivotally supported in the stock 10 at a pivot axle 31 and includes a lower end extended downward beyond the stock 10 such that the trigger 30 is accessible to a user. A spring 32 is disposed in the trigger 30 and biased between the stock 10 and the trigger 30 so as to bias the trigger 30 to an untriggered position, as shown in solid lines in FIG. 3. A shoulder 33 is formed in the free end portion of an extension 34 which is extended from the trigger 30. A member 35 which is preferably resilient is disposed on the rear end portion of the stock 10 and includes two depressions 36, 37 formed therein and located above the recess 25 of the stock 10.

A lever 40 includes a middle portion pivotally disposed in the rear end portion of the stock 10 at a pivot axle 41 and includes a first end extended upward into the recess 25 of the stock 10 and engageable with either of the depressions 36, 37 of the member 35 and includes a second end engageable with the shoulder 33 of the trigger 30. A protrusion 42 is formed integral on the lever 40 close to the first end thereof and is accessible to the user such that the lever 40 can be rotated about the pivot axle 41. The trigger 30 is locked when the first end of the lever 40 is engaged with the depression 37 of the member 35 and when the second end of the lever 40 is engaged with the shoulder 33 of the trigger 30. The trigger 30 can be unlocked when the lever 40 is rotated such that the first end thereof is engaged with the depression 36 of the member 35.

Figure 4:
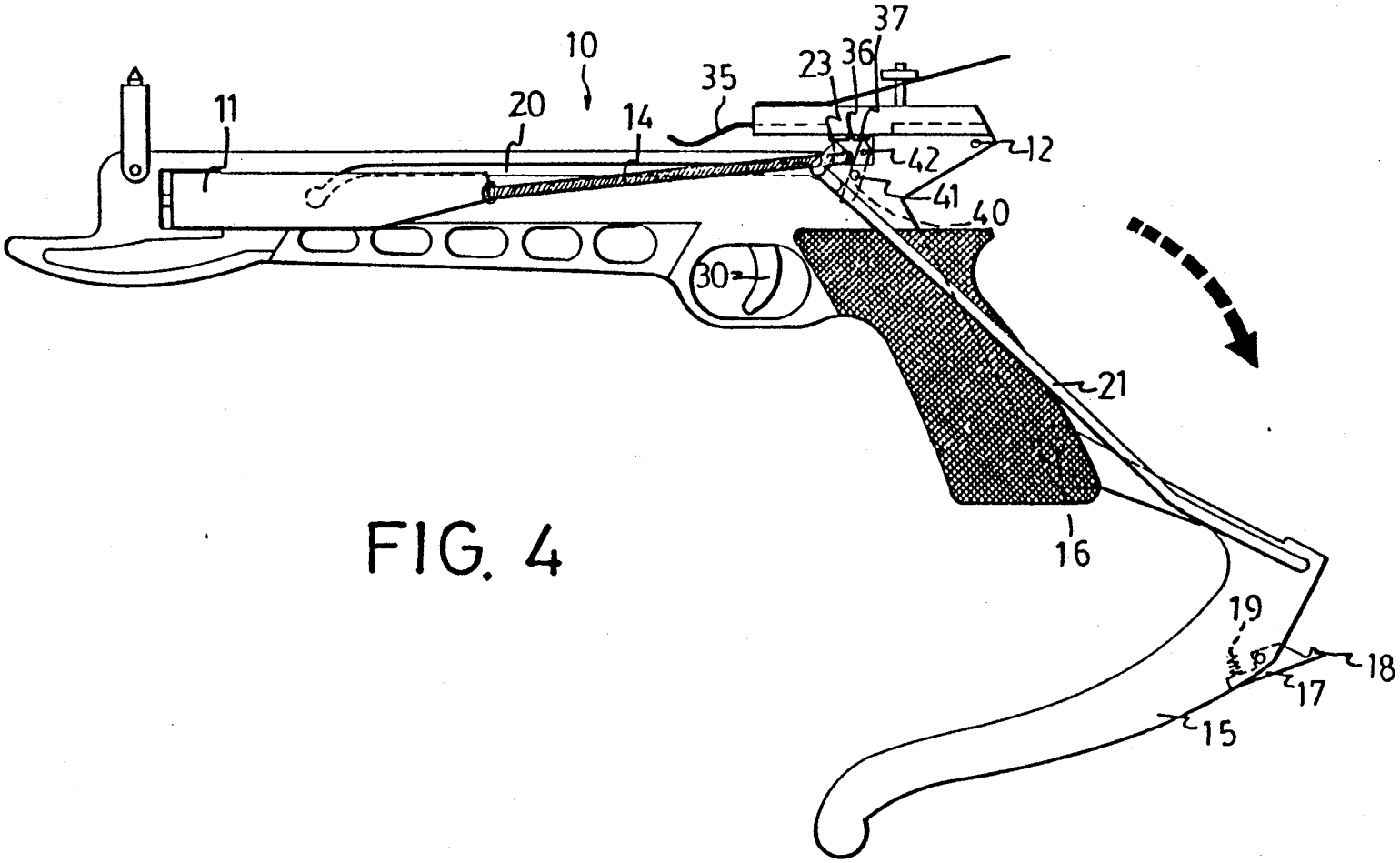
FIG. 4 is a schematic view illustrating the operations of the cross bow.

In operation, as shown in FIG. 4, when the bow is to be cocked, the first end of the catch 17 is depressed downward such that the hook 18 is separated from the engagement with the pin 12 and such that the butt 15 can be rotated about the pivot axle 16. The first end of the lever 40 is pushed rearward by the snag 23 and the string 14 when the string 14 is pulled to the cocked position where it is engaged in the recess 25, such that the trigger 30 is locked simultaneously, the user need not take any further action to lock the trigger 30. When it is required to unlock the trigger 30, it is only required to rotate the lever 40 by the protrusion 42 such that the first end of the lever 40 is engaged with the depression 36 of the member 35.

Accordingly, the trigger of the cross bow in accordance with the present invention can be easily locked and can be easily unlocked.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A cross bow comprising a stock including a front end and a rear end having a pin disposed therein, a bow prod supported on said front end of said stock, a string having opposite ends attached to corresponding ends of said bow prod, a cocking means for engaging said string and drawing said string from a rest position to a cocked position where said string is spaced rearwardly from said bow prod when said bow is cocked, a butt pivotally coupled to said rear end of said stock and including a catch disposed thereon for engagement with said pin of said stock so that said butt can be coupled to said stock, a recess formed in said rear end of said stock, a member disposed on said rear end of said stock and including a first depression and a second depression formed therein, a trigger disposed in said stock close to said rear end thereof and including a shoulder formed therein, and a lever having a middle portion pivotally coupled to said stock and including a first end engageable with either of said first depression and said second depression and a second end engageable with said shoulder of said trigger so as to lock said trigger when said first end of said lever is engaged with said second depression of said member, means connected to said cocking means for pushing said first end of said lever to engage with said second depression and said second end of said lever to engage with said shoulder of said trigger when said string is drawn to said cocked position such that said trigger is locked, and means to unlock said trigger comprising means to cause said lever to move to engage with said first depression of said member.

2. A cross bow comprising a stock including a front end, a rear end having a pin disposed therein and two side surfaces, a bow prod supported on said front end of said stock, a string having opposite ends attached to corresponding ends of said bow prod, a cam track formed in each of said side surfaces of said stock, a butt pivotally coupled to said rear end of said stock and including a catch disposed thereon for engagement with said pin of said stock so that said butt can be coupled to said stock, two bars each including a first end pivotally engaged with said butt and a second end slidably engaged with each of said cam tracks so that said second ends of said bars can be caused to slide along said cam tracks, a snag formed integral on said second end of each of said bars for engagement with said string so that said string can be drawn from a rest position to a cocked position where it is rearwardly separated from said bow prod when said bow is cocked, a recess formed in said rear end of said stock, a member disposed on said rear end of said stock and including a first depression and a second depression formed therein, a trigger disposed in said stock close to said rear end thereof and including a shoulder formed therein, and a lever having a middle portion pivotally coupled to said stock and including a first end engageable with either of said first depression and said second depression and a second end engageable with said shoulder of said trigger so as to lock said trigger when said first end of said lever is engaged with said second depression of said member, said snag on one of said bars pushing said first end of said lever to engage with said second depression and said second end of said lever to engage with said shoulder of said trigger when said string is drawn to said cocked position such that said trigger is locked, and means to unlock said trigger comprising means to cause said lever to move to engage with said first depression of said member.

3. A cross bow comprising a stock including a front end, a rear end having a pin disposed therein and two side surfaces, a bow prod supported on said front end of said stock, a string having opposite ends attached to corresponding ends of said bow prod, a cam track formed in each of said side surfaces of said stock, a butt pivotally coupled to said rear end of said stock and including a catch disposed thereon for engagement with said pin of said stock so that said butt can be coupled to said stock, two bars each including a first end pivotally engaged with said butt and a second end slidably engaged with each of said cam tracks so that said second ends of said bars can be caused to slide along said cam tracks, a snag formed integral on said second end of each of said bars for engagement with said string so that said string can be drawn from a rest position to a cocked position where it is rearwardly separated from said bow prod when said bow is cocked, a recess formed in said rear end of said stock, a member disposed on said rear end of said stock and including a first depression and a second depression formed therein and located above said recess of said stock, a trigger disposed in said stock close to said rear end thereof and including an extension extended therefrom, said extension including a free end portion having a shoulder formed therein, and a lever having a middle portion pivotally coupled to said stock and including a first end extended upward into said recess of said stock and engageable with either of said first depression and said second depression and a second end engageable with said shoulder of said trigger so as to lock said trigger when said first end of said lever is engaged with said second depression of said member, said snag on one of said bars pushing said first end of said lever to engage with said second depression and said second end of said lever to engage with said shoulder of said trigger when said string is drawn to said cocked position such that said trigger is locked, and means to unlock said trigger comprising means to cause said lever to move to engage with said first depression of said member.

* * * * *